US008640371B1

(12) United States Patent
Corr

(10) Patent No.: US 8,640,371 B1
(45) Date of Patent: Feb. 4, 2014

(54) UNIVERSAL SIGN POST BASE

(71) Applicant: Robert F. Corr, Sauquoit, NY (US)

(72) Inventor: Robert F. Corr, Sauquoit, NY (US)

( * ) Notice: Subject to any disclaimer, the term of this patent is extended or adjusted under 35 U.S.C. 154(b) by 0 days.

(21) Appl. No.: 13/671,890

(22) Filed: Nov. 8, 2012

Related U.S. Application Data

(60) Provisional application No. 61/565,293, filed on Nov. 30, 2011.

(51) Int. Cl.
*G09F 15/00* (2006.01)

(52) U.S. Cl.
USPC ..... 40/607.1; 40/607.01

(58) Field of Classification Search
USPC ..... 40/607.1, 607.01, 607.05, 607.06, 40/607.08, 612; 248/156; 52/153, 298; 256/65.14
See application file for complete search history.

(56) References Cited

U.S. PATENT DOCUMENTS

| | | | | |
|---|---|---|---|---|
| 1,975,157 | A * | 10/1934 | Kraft | 312/140.4 |
| 5,197,819 | A * | 3/1993 | Hughes | 404/13 |
| 6,640,517 | B2 * | 11/2003 | Mitchell | 52/298 |
| 7,819,605 | B2 * | 10/2010 | Heald | 404/9 |
| 7,883,070 | B2 * | 2/2011 | Schroeder et al. | 248/545 |
| 8,082,702 | B2 * | 12/2011 | Hill | 52/155 |

* cited by examiner

*Primary Examiner* — Joanne Silbermann
*Assistant Examiner* — Christopher E Veraa
(74) *Attorney, Agent, or Firm* — Luedeka Neely Group, P.C.

(57) ABSTRACT

A weighted sign post base which may be formed in various weights and has a central portion made of resilient material, such as compression molded rubber, having a universal sign post mounting hole molded into the center of the base. The universal sign post mounting hole is uniquely shaped to create a friction grip sufficient to secure the sign post to the universal sign post base upon insertion of the sign post into the universal sign post mounting hole, thereby eliminating the need of any mounting hardware and allowing speedy erection of the sign.

10 Claims, 3 Drawing Sheets

UNIVERSAL SIGN POST BASE

CROSS REFERENCE TO RELATED APPLICATIONS

This application claims the benefit of the filing date of copending provisional application No. 61/565,293 filed Nov. 30, 2011.

FIELD OF THE INVENTION

This invention relates in general to sign post bases and, in particular, to a weighted sign post base having an opening formed therein which is adapted to receive a variety of differing shaped sign posts having various cross-section configurations, thereby obviating the heretofore need for having separate weighted sign bases with different shaped post receiving openings to receive the various cross-section configurations of such posts, and the attendant inventory and mounting hardware for each of the various different cross-sectional shaped sign posts in common use. This sign base eliminates the necessity and costs of maintaining separate inventories of weighted sign post bases having different sign post receiving openings to accommodate each of the different sign post constructions in general use throughout the industry. In a preferred embodiment, the invention can be utilized with any of the conventional sign posts such as used for displaying informational or warning data as might be used in a parking area or other public area, along a roadway during construction, or to direct the flow of traffic.

BACKGROUND OF THE INVENTION

Whenever it is necessary or desirable to display information in public or private facilities, such as in a parking area or other public area, a sign bearing such information is posted in the general area in which it is necessary to convey such information. Whether this information is to be displayed indoors or outdoors, it is generally most convenient to post the information on a sign in the general area in which the information is most relevant. Accordingly, it is most usual that the information is displayed on a sign which is mounted to a sign post, and the sign post is secured in a manner whereby the sign will remain on display in the position posted.

When it is not possible, or it is preferable that such a sign not be posted permanently, the sign post upon which the sign is mounted is usually secured to a weighted base. The weight of such a base is determined by the size of the sign and its location relative to forces that may act against the sign such as wind loading or possible impact by pedestrians or vehicular traffic. Because of the different forms and shapes of sign posts in common use for this purpose, a sizeable inventory of such bases having different shaped openings to receive the various cross-section configurations of sign posts in common use throughout the industry has been required. Each of these items adds to the costs of the base and is reflected in the price the consumer pays in both material and labor for such signage.

Accordingly, it would be very desirable to have a sign post base with a universal sign post receiving opening or hole formed therein which will accommodate the most common standard sign posts thereby requiring no additional mounting hardware or adapters. Such a universal sign post base would be capable of receiving and holding such sign posts by only the friction of inserting the various sign posts into the unique shaped opening formed in the universal base.

SUMMARY OF THE INVENTION

In accordance with one embodiment of the present invention, there is provided a weighted sign post base which may be formed in various weights and has a central portion made of resilient material, such as compression molded rubber, having a universal sign post mounting hole molded into the center of the base. The universal sign post mounting hole is uniquely shaped to create a friction grip sufficient to secure the sign post to the universal sign post base upon insertion of the sign post into the universal sign post mounting hole, thereby eliminating the need of any mounting hardware and allowing speedy erection of the sign. The unique shape of the sign post mounting hole also allows for all the various standard posts to be approximately centered in the middle of the sign post base so that maximum stability is obtained regardless of the cross sectional shape of the post.

The present invention is directed to attaining these goals, and overcoming one or more of the problems or disadvantages associated with the relevant technology, as will be more readily understood and fully appreciated from the following detailed description of a preferred embodiment of the present invention.

DESCRIPTION OF THE DRAWINGS

Further objectives of the invention, together with additional features contributing thereto and advantages accruing therefrom, will be apparent from the following description of a preferred embodiment of the invention as shown in the accompanying drawings.

DETAILED DESCRIPTION OF PREFERRED EMBODIMENTS

Figure 1:
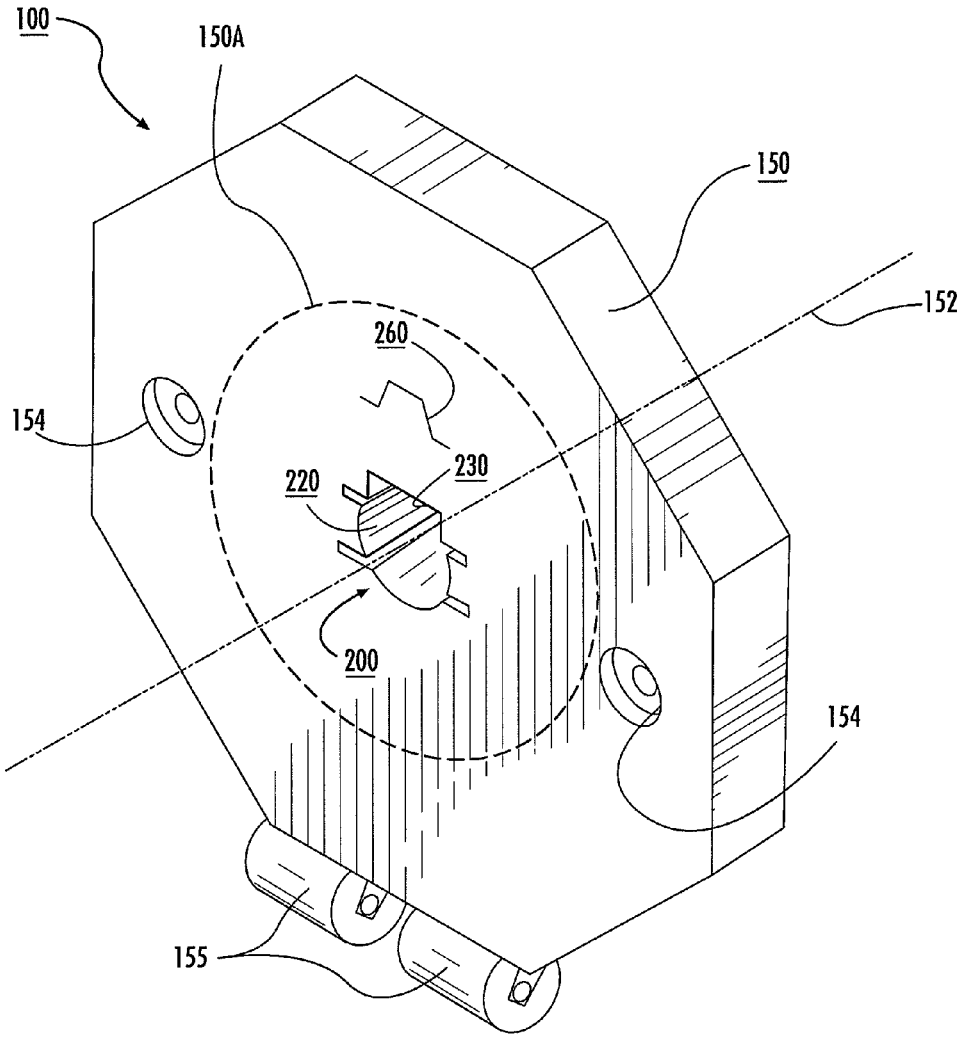
FIG. 1 is a perspective view of one embodiment of the invention equipped with optional wheels to better illustrate a universal sign post base constructed in accordance therewith.

Referring now to the drawings, wherein like reference numerals indicate like parts throughout, there is illustrated a preferred embodiment of the invention 100. As best illustrated in FIG. 1, there is shown a perspective view of a universal sign post base 150 formed from a resilient material, such as rubber, having a universal sign post mounting hole or opening 200 formed therein. The sign post base 150 in this figure is shown with an optional pair of wheels 155 which can be secured to an edge or side of the base 150 to facilitate movement of a sign mounted on the base as necessary.

While the sign post base 150 illustrated is preferably formed of compression molded rubber, the sign post base may be made from a heavier non-resilient material having a central portion 150A, illustrated by dashed lines, made from resilient material in which the mounting hole 200 is formed. Throughout this description terms such as sign post, sign base and sign post mounting hole are used for convenience of illustration. However, these terms are meant to be interchangeable with post, base and post mounting hole. The reference to the use of such terms with signage is not to limit the invention, but to illustrate one of the preferred embodiments of the invention.

The sign post mounting hole 200 is formed in the center of the sign post base 150 and extends there through along a longitudinally extending center axis 152 of the base. If it is desirable to attach the sign post base 150 to an immovable surface upon which the sign post base is placed, such as to prevent movement of the sign due to, for example, heavy wind loading, a pair of openings 154 is formed in the sign post base 150 to permit the sign post base to be temporarily or removably secured to such a surface by suitable standard fasteners such as bolts or screws.

The unique shape of the sign post mounting hole 200 which accommodates the securing of the several various standard sign posts to the sign post base 150, comprises a partial cylindrical opening 220 extending through the base 150 with a center axis coaxial with the base center axis 152; a rectangular channel 230 contiguous with the partial cylindrical opening 220; a castellated cut 260 formed in the sign post base; and two pair of channels 270 and 280 contiguous with the partial cylindrical opening 220 and extending horizontally outwardly therefrom in parallel planes.

The rectangular channel 230 which is contiguous with the partial cylindrical opening 220 is formed by two sides 232 extending outwardly and upwardly from the non-cylindrical portion of the partial cylindrical opening 220 throughout the length thereof. The two parallel sides 232 are joined by a web 234 having a longitudinal axis extending parallel to the base center axis 152. In this manner the rectangular channel 230 and the partial channel 220 have a cross-section configuration substantially in a form to receive a standard round post or a standard square post, including a standard nested square post.

A castellated cut 260 is formed through the base 150 and comprises a web cut portion 262 having a longitudinal axis extending parallel to the web 234 of the rectangular channel 230 and the base center axis 152. Each end of the web cut portion 262 is contiguous with the proximate end of an outwardly and downwardly sloping depending flaring cut portion 264. The distal end of the flaring cut portion 264 of the castellated cut 260 is contiguous with an end cut portion 266 which extends outwardly therefrom parallel to the web 234 of the rectangular channel 230. In this manner the castellated cut 260 formed in the base 150 has a cross-section configuration substantially in the form of a flared "U", which corresponds to the cross-section of a standard thin or 1.12 U-channel post.

Figure 2:
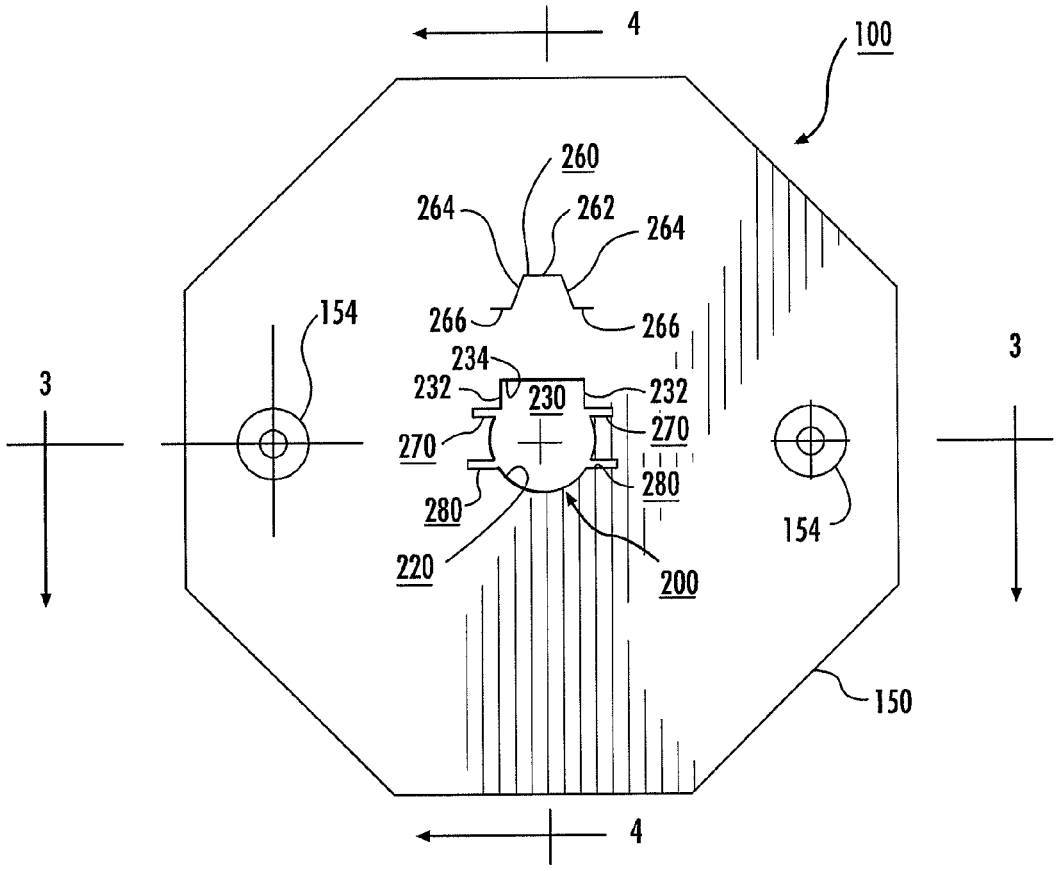
FIG. 2 is front planar view of the embodiment of the invention illustrated in FIG. 1, with optional wheels removed, better illustrating the unique shape of the universal sign post mounting hole opening.
Figure 3:
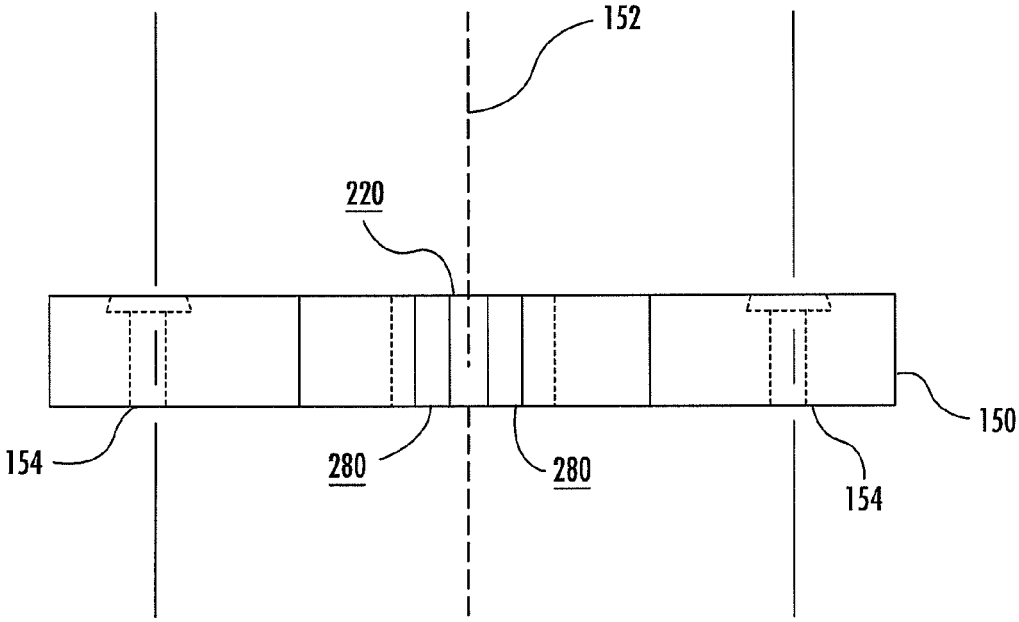
FIG. 3 is a cross sectional view of the embodiment of the invention illustrated in FIG. 2 taken along lines 3-3.
Figure 4:
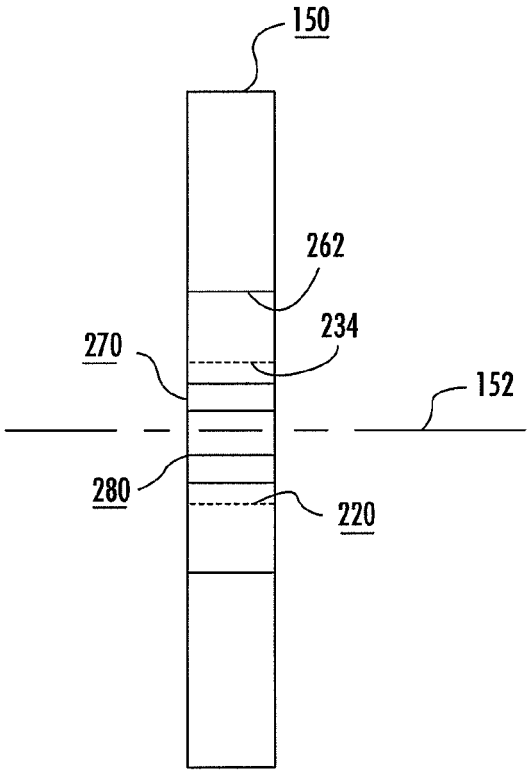
FIG. 4 is another cross sectional view of the embodiment of the invention illustrated in FIG. 2 taken along lines 4-4.

The cylindrical portion of the partial cylindrical opening 220 has two pairs of horizontally extending slots 270 and 280 extending outwardly therefrom with the separate slots of each pair of slots being formed in separate common horizontal planes with one of such horizontal planes being spaced above and the other being spaced below the base center axis 152. As best illustrated in FIG. 2, the pair of slots 280 spaced below the base center axis extend farther outwardly than the pair of slots 270 which are spaced above the base center axis 152. In this manner the sign post mounting hole can accommodate different size U-channel posts having differing channel depths and widths such as the standard 2# and 3# U-Channel posts.

While this invention has been described in the specification and illustrated in the drawings with reference to a preferred embodiment, the structure of which has been disclosed herein, it will be understood by those skilled in the art to which this invention pertains that various changes may be made and equivalents may be substituted for elements of the invention without departing from the scope of the claims. Therefore, it is intended that the invention not be limited to the particular embodiment disclosed in the specification and shown in the drawings as the best mode presently known by the inventor for carrying out this invention, nor confined to the details set forth, but that the invention will include all embodiments, modifications and changes as may come within the scope of the following claims.

This application was prepared without reference to any particular dictionary. Accordingly, the definition of the terms used herein conforms to the meaning intended by the inventor acting as his own lexicographer, in accordance with the teaching of the application, rather that any dictionary meaning which is contrary to or different from the inventor's meaning regardless of the authoritativeness of such dictionary.

What is claimed is:

1. A universal sign post base having a unique universal sign post mounting hole for securing sign posts having various cross-section configurations to the base, the universal sign post base comprising:

a sign supporting base having at least a central portion thereof formed of a resilient material capable of having a sign post supporting hole formed therein;

a sign post supporting hole formed in said sign supporting base and having a longitudinally extending center axis extending through the center of said base;

said sign post supporting hole including a partially cylindrical opening formed in said base and having a center axis coaxial with said longitudinally extending center axis extending through the center of said base; and two pairs of horizontally extending slots extending outwardly from a cylindrical portion of said partial cylindrical opening with the separate slots of each pair of slots being formed in separate common horizontal planes spaced one from the other in two horizontally extending planes with one of said two horizontal planes being spaced above and the other of said two horizontal planes being spaced below said base center axis.

2. The universal sign post base having a unique universal sign post mounting hole for securing sign posts having various cross-section configurations to the base as defined in claim 1, further including:

a castellated cut formed in said base; and said castellated cut formed in said base having a web lying in a plane extending parallel to said base center axis.

3. The universal sign post base having a unique universal sign post mounting hole for securing sign posts having various cross-section configurations to the base as defined in claim 2 wherein said castellated cut is formed through said base.

4. The universal sign post base having a unique universal sign post mounting hole for securing sign posts having various cross-section configurations to the base as defined in claim 3 wherein each end of said web cut portion is contiguous with a proximate end of an outwardly and downwardly sloping depending flaring cut portion;

and the distal end of each said flaring cut portion is contiguous with an end cut portion which extends outwardly therefrom parallel to said web.

5. The universal sign post base having a unique universal sign post mounting hole for securing sign posts having various cross-section configurations to the base as defined in claim 1 wherein said sign supporting base is formed completely from a resilient material capable of having a sign post supporting hole formed therein.

6. The universal sign post base having a unique universal sign post mounting hole for securing sign posts having various cross-section configurations to the base as defined in claim 1 wherein said resilient material is compressed rubber.

7. The universal sign post base having a unique universal sign post mounting hole for securing sign posts having various cross-section configurations to the base as defined in claim 1 wherein said universal sign post mounting hole extends completely through said base.

8. The universal sign post base having a unique universal sign post mounting hole for securing sign posts having various cross-section configurations to the base as defined in claim 1 wherein said pair of slots formed in said upper one of said two horizontal planes spaced above the other of said two horizontal planes extends outwardly a lesser distance than said pair of slots formed in said other of said two horizontal planes spaced below said base center axis.

9. The universal sign post base having a unique universal sign post mounting hole for securing sign posts having various cross-section configurations to the base as defined in claim 1, further including at least one roller secured to said base to facilitate movement thereof.

10. The universal sign post base having a unique universal sign post mounting hole for securing sign posts having various cross-section configurations to the base as defined in claim 1, further including at least one opening formed in said base to permit said sign post base to be removably secured to an immovable surface.

* * * * *